United States Patent [19]

Bannister

[11] 4,324,359

[45] Apr. 13, 1982

[54] HEAT RECLAIMING SYSTEM

[76] Inventor: Wayne O. Bannister, 1502 Nance St., Newberry, S.C. 29108

[21] Appl. No.: 173,096

[22] Filed: Jul. 28, 1980

[51] Int. Cl.[3] ..... F24F 7/00
[52] U.S. Cl. ..... 237/46; 237/50
[58] Field of Search ..... 237/48, 50, 51, 46; 126/121

[56] References Cited

U.S. PATENT DOCUMENTS 4,168,797 9/1979 Luke ..... 237/48

*Primary Examiner*—Ronald C. Capossela

[57] ABSTRACT

This heat reclaiming system consists primarily of an insulated duct with an inlet grille in the ceiling of a room, in which is a heating source. It further includes a blower, intermediate with a second duct, which is secured to an outlet duct in an adjacent room, so as to transfer the heat, at the ceiling of the room with the heating source, to the adjacent room.

1 Claim, 1 Drawing Figure

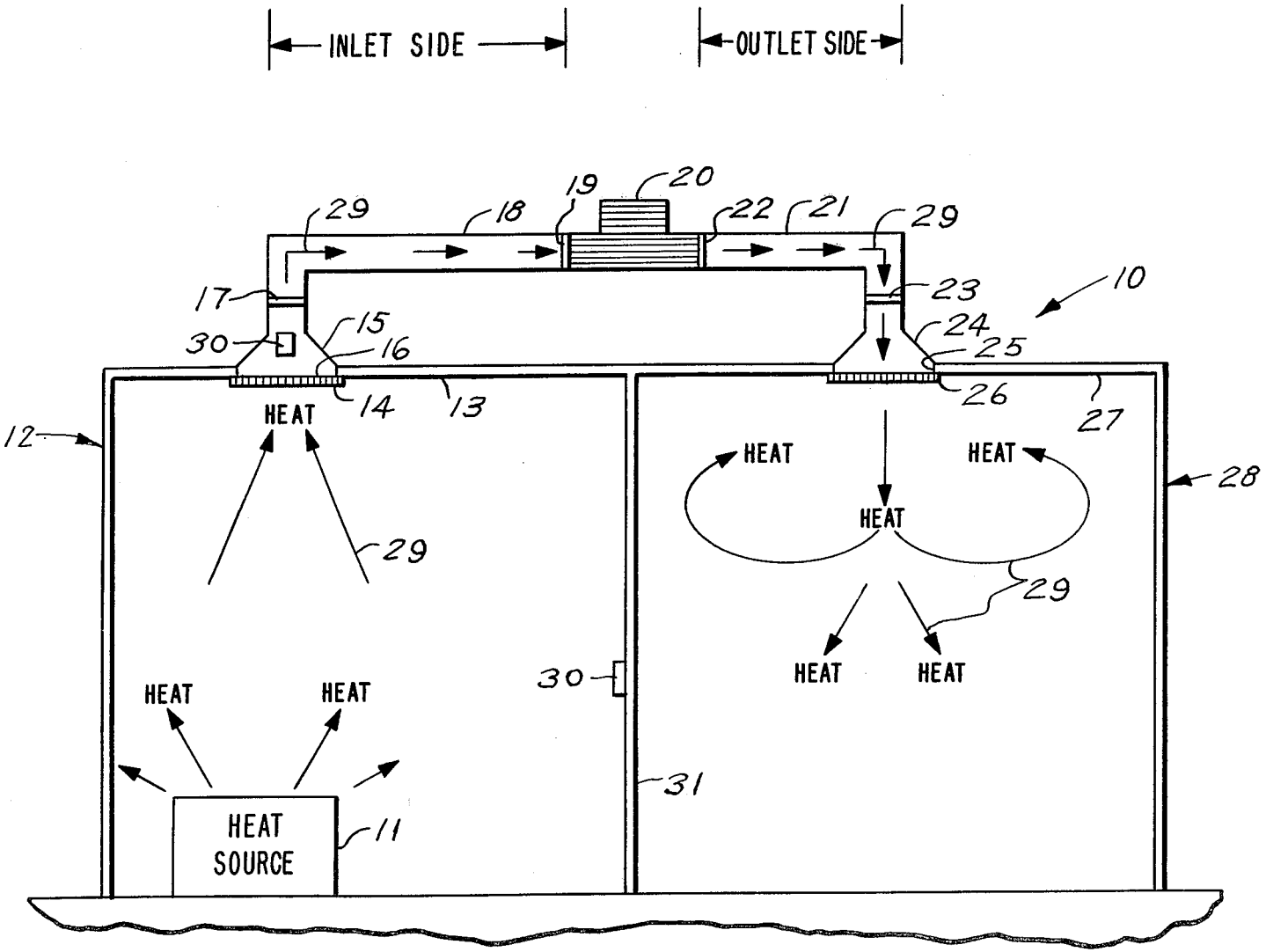
INLET SIDE
OUTLET SIDE
HEAT
HEAT SOURCE
10
11
12
13
14
15
16
17
18
19
20
21
22
23
24
25
26
27
28
29
30
31

HEAT RECLAIMING SYSTEM

This invention relates to heat transfer systems, and more particularly to a heat reclaiming system.

It is the principal object of this invention to provide a heat reclaiming system, which will be a heat transfer medium for reclaiming heat that is normally lost, due to ceiling height.

Another object of this invention is to provide a heat reclaiming system, which will be adaptable to various heat sources, such as wood stoves, furnaces, gas heaters, etc.

A further object of this invention is to provide a heat reclaiming system, which will, by duct and blower means, through the use of a thermostat, transfer heat from the ceiling, in which is the heat source, to an adjacent room or rooms.

Other objects of the present invention are to provide a heat reclaiming system, which is simple in design, inexpensive to manufacture, rugged in construction, easy to use and efficient in operation.

Other objects of the invention will become readily evident, upon a study of the specification and the accompanying drawing.

BRIEF DESCRIPTION OF THE DRAWING

The FIGURE is a side elevation view of the heat reclaiming system of the present invention.

According to this invention, system 10 is shown to include a heat producing source 11, in room 12. In the ceiling 13, of room 12, is a grille 14, secured in a suitable manner (not shown), over a vent 15 in opening 16. A suitable clamping device 17 serves to hold vent 15 to one end of an inlet duct 18, and the opposite end of duct 18 is secured by clamping device 19 to a blower 20. An outlet duct 21 is secured, by a clamping device 22, to the outlet side of blower 20, and the opposite end of duct 21 is secured, by clamping device 23, to outlet vent 24, which is received in opening 25 of ceiling 27 of room 28.

In operation, the heat, indicated by the arrows 29, is pulled into blower 20 from room 12, where it is forced out of vent 25 into room 28, and system 10 will enable room 12 to become more evenly heated, while supplementing room 28 with reclaimed heat from room 12.

It shall be noted, that system 10 can be monitored and regulated by a thermostat 30, on the divider wall 31, or it may be installed in the vent 15 of room 12, and, in either location, it will detect room temperature and activate the blower 20.

It shall also be recognized that, in certain instances, this invention may be adaptable to existing heating and/or cooling system duct work, provided appropriate damping features are incorporated.

While various changes may be made in the detail construction, it is understood that such changes will be within the spirit and scope of the present invention, as is defined by the appended claims.

What I now claim is:

1. A heat reclaiming system, comprising, in combination, an inlet vent covered by a grill, and secured in a ceiling opening of a first room having a heat source; an inlet duct secured by a clamp to said inlet vent, said inlet duct being connected by a clamp to an inlet side of a blower; an outlet duct secured by a clamp to an outlet side of said blower, said outlet duct being connected by a clamp to an outlet vent covered by a grill, and located in a ceiling opening of a second room having need of more heat therein; whereby heated air adjacent the ceiling of said first room is reclaimed to said second room, both said vents, both said ducts and said blower being located at an elevation above both said ceilings; and a thermostat activating said blower being located on a wall of said first room.

* * * * *